US005515576A

United States Patent [19]

Tsai

[11] Patent Number: 5,515,576

[45] Date of Patent: May 14, 1996

[54] RETRACTABLE HANDLE FOR LUGGAGE OR HAND TRUCKS

[76] Inventor: James Tsai, 103, Ta Ming 1 Rd., Tung Pao Tsun, Tan Tzu Hsiang, Taichung Hsien, Taiwan

[21] Appl. No.: 324,689

[22] Filed: Oct. 18, 1994

[51] Int. Cl.[6] ..... B25G 1/04

[52] U.S. Cl. ..... 16/115; 280/655; 190/14

[58] Field of Search ..... 16/115, 111 R, 16/DIG. 38; 280/47.315, 655, 655.1, 47.371; 190/14, 15 R, 104, 18 R, 18 A

[56] References Cited

U.S. PATENT DOCUMENTS

| | | | |
|---|---|---|---|
| 3,572,870 | 3/1971 | Marks | 16/115 |
| 4,577,877 | 3/1986 | Kassai | 16/115 |
| 4,896,897 | 1/1990 | Wilhelm | 280/655 |
| 5,178,404 | 1/1993 | Chen | 280/655 |
| 5,181,590 | 1/1993 | Carpenter et al. | 190/18 A |
| 5,291,976 | 3/1994 | Ku | 16/115 |
| 5,294,145 | 3/1994 | Cheng | 280/655 |
| 5,295,565 | 3/1994 | Latshaw | 190/18 A |
| 5,323,886 | 6/1994 | Chen | 190/18 A |
| 5,355,980 | 10/1994 | Hsieh | 190/18 A |
| 5,374,073 | 12/1994 | Hung-Hsin | 190/18 A |

*Primary Examiner*—Maurina T. Rachuba
*Assistant Examiner*—Chuck Y Mah
*Attorney, Agent, or Firm*—Bacon & Thomas

[57] ABSTRACT

A retractable handle includes two parallel sleeves, a hollow cross member connected between the sleeves at the top, and two extension rods connected in parallel and moved in and out of the sleeves. The cross member is provided with a spring supported pressure plate, the pressure plate having two oblique guide grooves at two opposite ends and two spring supported lock bolts received in the guide grooves. The lock bolts are forced through through holes on the cross member and the sleeves into locating holes on the extension rods to lock the extension rods in position when the extension rods are extended out of the sleeves; the lock bolts are released from the locating holes on the extension rods when the pressure plate is depressed, permitting the extension rods to be moved to the collapsed position received inside the sleeves.

4 Claims, 4 Drawing Sheets

RETRACTABLE HANDLE FOR LUGGAGE OR HAND TRUCKS

BACKGROUND OF THE INVENTION

The present invention relates to a retractable handle for a luggage or hand truck which comprises two spring-supported lock bolts controlled by a pressure plate to lock the extension rods in the working position out of the sleeves.

Various luggage and folding collapsible hand trucks are well known and extensively used by travelers for carrying things. These luggage and hand trucks commonly have a retractable handle for moving with the hand and tightening up screws for locking the retractable handle in the operative position. This structure of retractable handle is complicated and inconvenient to operate. Because the locking of the retractable handle by the tightening up screws is achieved by friction force, the friction area between the retractable handle and the tightening up screw will wear away with use, causing the retractable handle to oscillate.

SUMMARY OF THE INVENTION

It is one object of the present invention to provide a locking device for a retractable handle which firmly locks the retractable handle in the operative position. It is another object of the present invention to provide a locking device for a retractable handle which is easy to operate. It is still another object of the present invention to provide a retractable handle which is simple in structure and easy to manufacture.

According to one aspect of the present invention, the retractable handle comprises two parallel sleeves, a hollow cross member connected between the sleeves at the top, and two extension rods connected in parallel and moved in and out of the sleeves. The cross member is incorporated with a spring supported pressure plate, which pressure plate has two oblique guide grooves at two opposite ends and two spring supported lock bolts received in the guide grooves. When the extension rods are extended out of the sleeves, the lock bolts are forced through through holes on the cross member and the sleeves into locating holes on the extensiuon rods to lock the extension rods in position. When the pressure plate is depressed, the lock bolts are forced out of the locating holes on the extension rods, permitting the extension rods to be moved to the collapsed position received inside the sleeves.

According to another aspect of the present invention, the moving direction of the lock bolts are perpendicular to the moving direction of the extension rods, therefore the extension rods do not oscillate when they are pulled or pushed after the lock bolts have been inserted into the locating holes.

DETAILED DESCRIPTION OF THE PREFERRED EMBODIMENT

Figure 1:
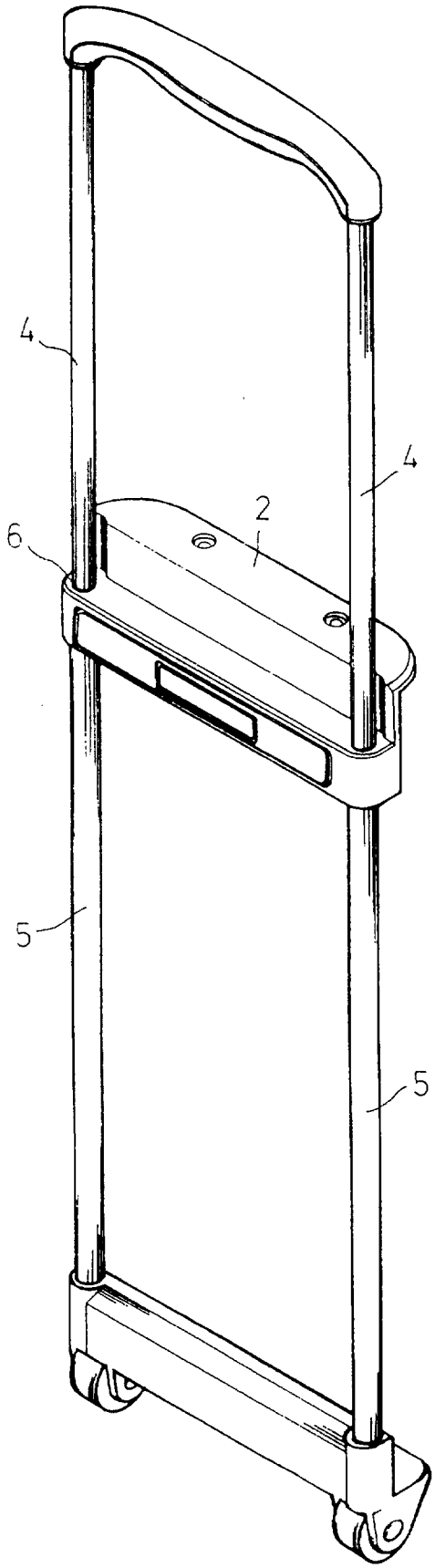
FIG. 1 is an elevational view of a retractable handle according to the present invention.
Figure 2:
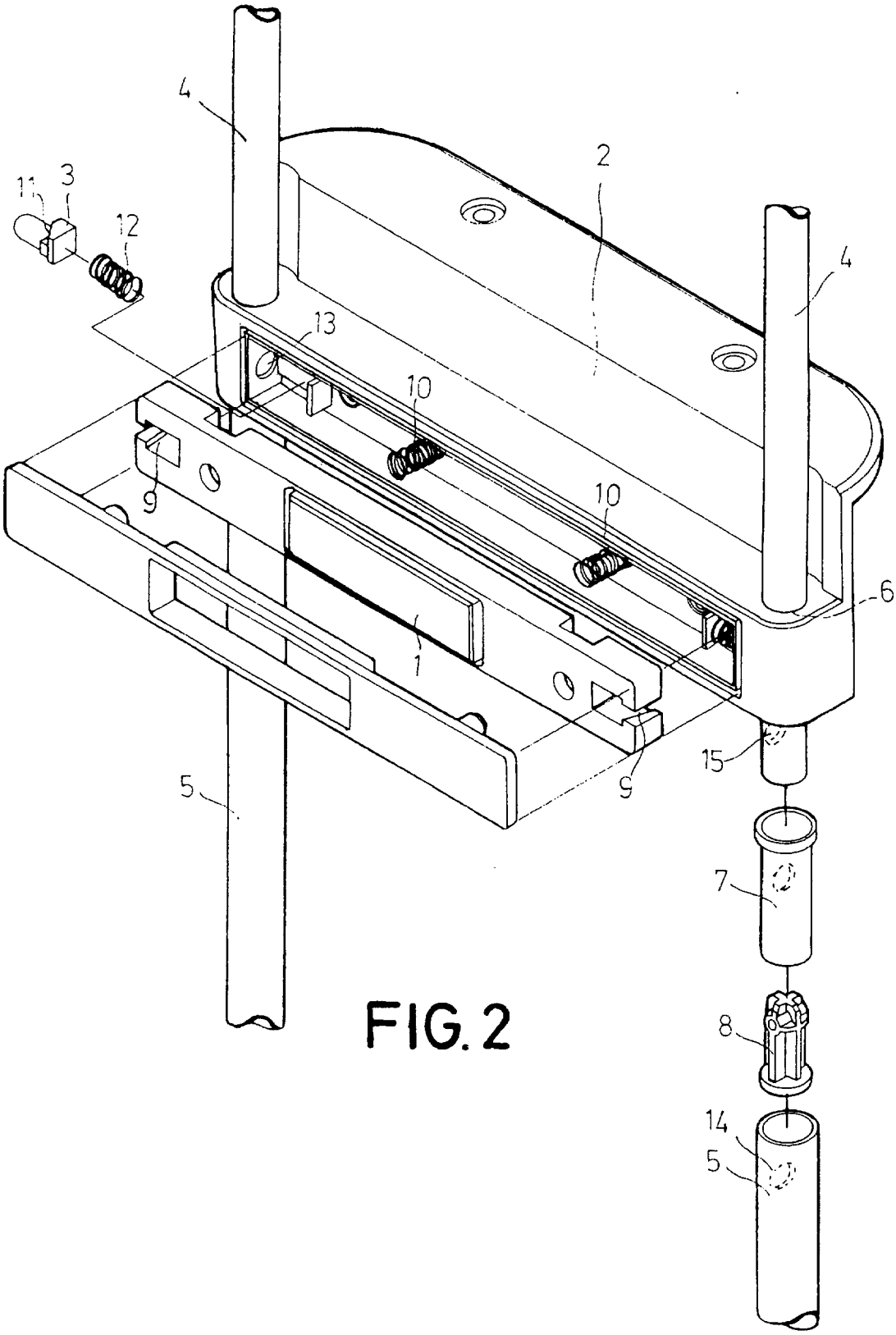
FIG. 2 is an exploded view of the retractable handle shown in FIG. 1.

Referring to FIGS. 1 and 2, a retractable handle in accordance with the present invention is generally comprised of a pressure plate 1, a hollow cross member 2, two lock bolts 3, a pair of sleeves 5, and a pair of extension rods 4 connected in parallel and moved in and out of the sleeves 5. The hollow cross member 2 has two through holes 6 near two opposite ends thereof, which receive the sleeves 5 and the extension rods 4 in the sleeves 5. The extension rods 4 are respective moved in and out of the sleeves 5, each having a bottom end coupled with stop members 7 and 8. By means of the respective stop members 7 and 8, the extension rods 4 do not disconnect from the sleeves 5 when they are extended out of the sleeves 5. The pressure plate 1 is mounted within the hollow cross member 2, supported on springs 10, and provided with two oblique guide grooves 9 on two opposite ends thereof, which receive the lock bolts 3 respectively. The lock bolts 3 are respectively supported on a respective spring 12, having a guide face 11 matched with the respective guide groove 9. Through holes 13 and 14 are respectively made in the cross member 2 and the sleeves 5 at locations corresponding to the lock bolts 3. The extension rods 4 have a respective locating hole 15 near the respective bottom end.

Figure 3A:
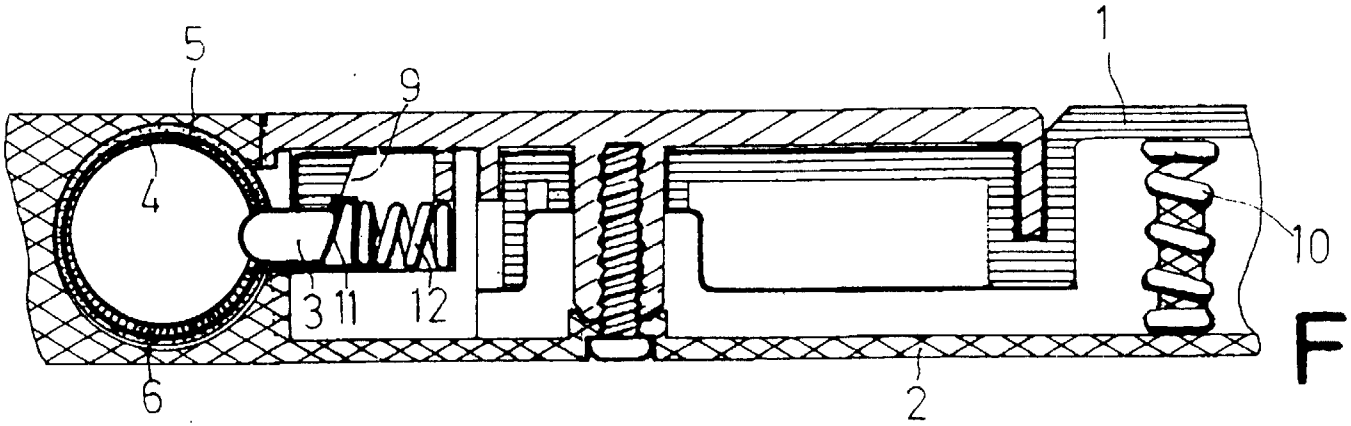
FIG. 3A is a partial view in section of the hollow cross member of the retractable handle shown in FIG. 1, showing the lock bolt inserted into the locating hole on the extension rod.

Referring to FIG. 3A, when the extension rods 4 are extended out of the sleeves 5, the locating holes 15 of the extension rods 4 are respectively aligned with the through holes 13 and 14 of the cross member 2 and the sleeves 5. When the through holes 13 and 14 and the locating holes 15 are respectively aligned, the lock bolts 3 are respectively forced into the through holes 13 and 14 and the locating holes 15 by the springs 12 to hold the extension rods 4 in the extended out position. Because the moving direction of the lock bolts 3 are perpendicular to the moving direction of the extension rods 4, the extension rods 4 do not oscillate when they are pulled or pushed after the lock bolts 3 have been inserted into the locating holes 15.

Figure 3B:
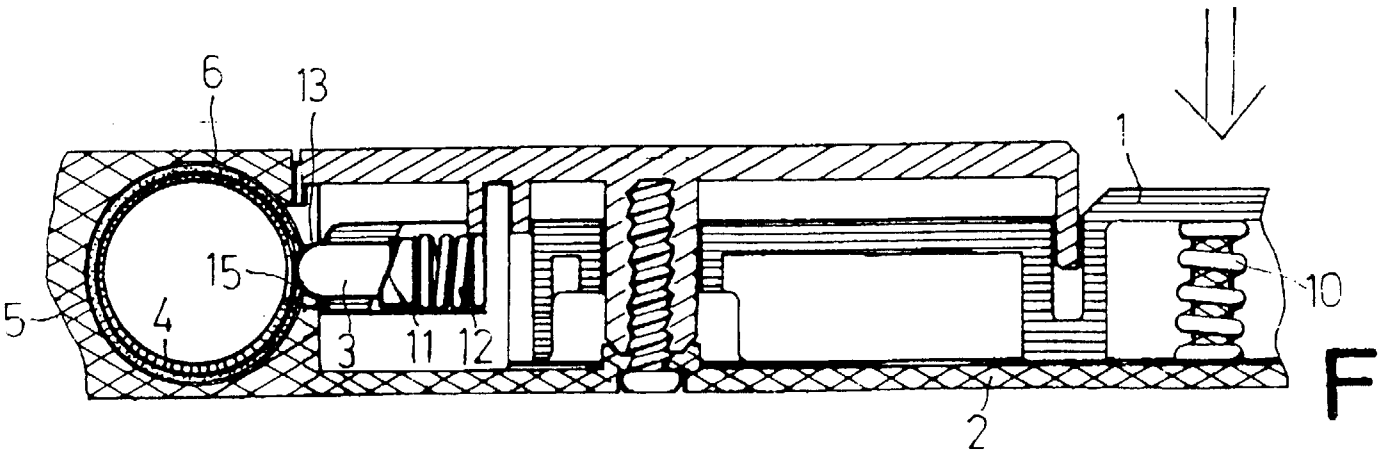
FIG. 3B is similar to FIG. 3A but showing the lock bolt released from the locating hole on the extension rod.

Referring to FIG. 3B, when the pressure plate 1 is depressed to compress the springs 10, the guide faces 11 of the lock bolts 3 are forced by the guide grooves 9 of the pressure plate 1, causing the lock bolts 3 to move through a camming action backwards from the locating holes 15 of the extension rods 4, and therefore the extension rods 4 are released from the lock bolts 3 and can be received inside the sleeves 5.

Figure 4:
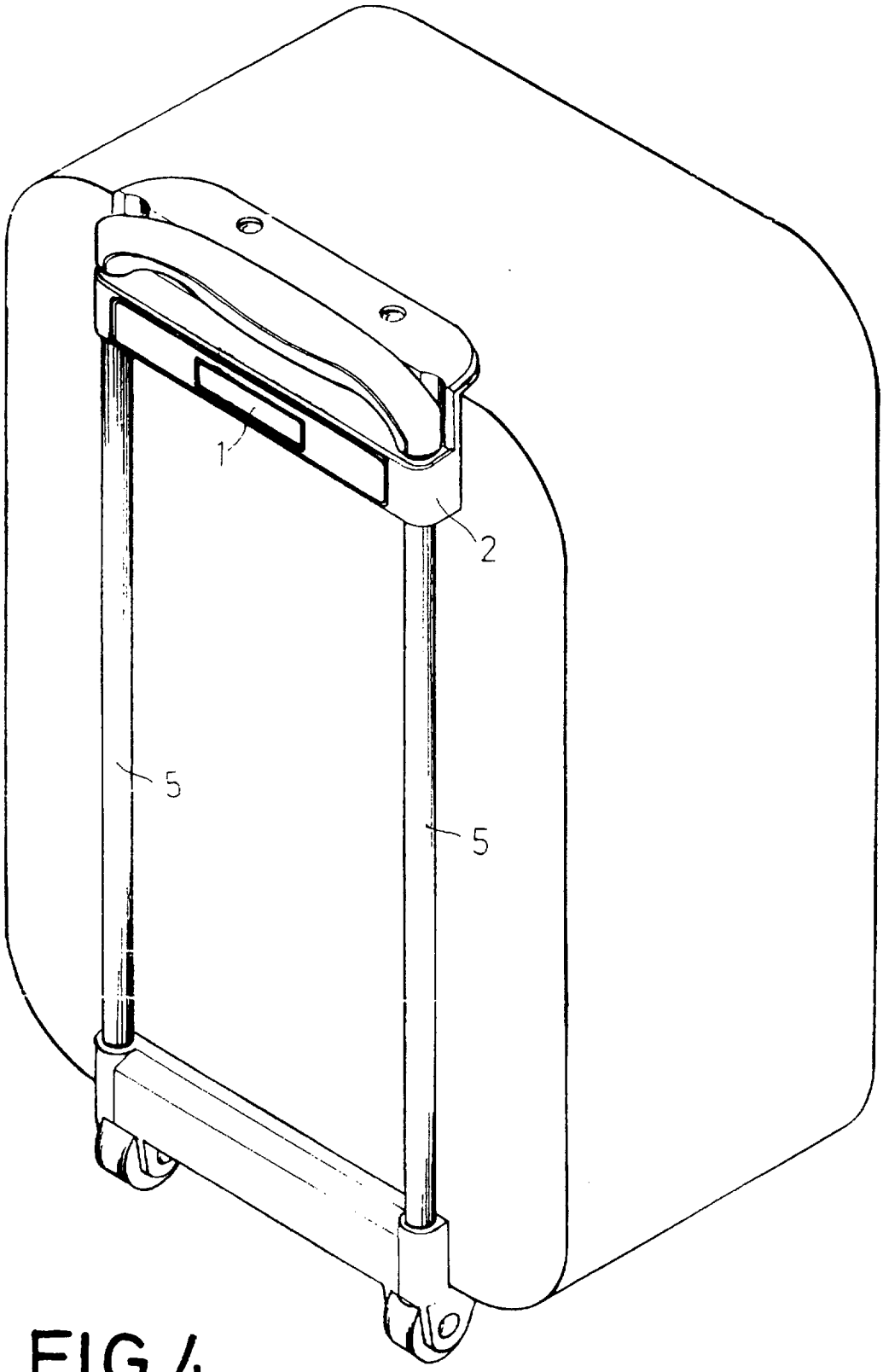
FIG. 4 is an applied view showing the retractable handle of the present invention installed in a luggage.

FIG. 4 shows the retractable handle fixed to a piece of luggage. The retractable handle may also be coupled with a supporting frame to form a hand truck.

While only one embodiment of the present invention has been shown and described, it will be understood that various modifications and changes could be made without departing from the spirit and scope of the invention.

What is claimed is:

1. A retractable handle assembly comprising:

a pair of laterally spaced, parallel sleeves, each of said sleeves including a top end portion provided with a laterally inwardly opening hole;

a cross member extending between said sleeves, said cross member having opposing ends each provided with an upstanding through hole which receives a respective one of said sleeves, said cross member including a hollow central portion between said opposing ends, said opposing ends also being formed with respective laterally extending through holes that are respectively aligned with the laterally inwardly opening holes provided in said sleeves;

a pair of laterally spaced, parallel extension rods each of which is slidably received in a respective one of said sleeves for movement between a retracted position in which said extension rods are substantially full retracted within said sleeves and an extended position, each of said extension rods including a lower end portion and an upper end portion, the lower end portion of each of said extension rods being provided with a locating hole that opens laterally inwardly and which is aligned with the laterally inwardly opening hole of a respective one of said sleeves and the laterally extending through hole in a respective end of said cross member when said extension rods are in said extended position;

a pair of lock bolt members positioned within said cross member at the opposing ends thereof, each of said lock bolt members including a pin portion being movable relative to said cross member between a locked position, in which said lock bolt members project into the laterally inwardly opening hole of a respective said sleeve, a respective said laterally extended through hole and a respective said locating hole to selectively retain said extension rods in said extended position, and an unlocked position wherein said lock bolt members are retracted laterally inwardly;

a pair of spring members biasing said lock bolt members toward said locking position;

a pressure plate movably mounted between first and second positions within the hollow central portion of said cross member, said pressure plate having guide grooves, formed at respective opposite ends thereof, which receive said lock bolt members;

spring means for biasing said pressure plate towards said first position; and camming means, acting between the guide grooves of said pressure plate and said lock bolt members, for causing said lock bolt members to be automatically placed in said unlock position when said pressure plate is shifted to said second position.

2. The retractable handle assembly according to claim 1, wherein said spring means comprises a plurality of laterally spaced springs arranged in said hollow central portion and extending between said cross member and said pressure plate.

3. The retractable handle assembly according to claim 1, wherein said camming means comprises an angled guide face formed on each of said lock bolt members and an angled surface of each of said guide grooves wherein shifting of said pressure plate from said first position to said second position causes each of said lock bolt members to shift laterally inwardly as a respective said angled guide face rides up on a respective said angled surface.

4. The retractable handle assembly according to claim 1, wherein said pair of spring members act directly between said cross member and said lock bolt members.

* * * * *